US005148346A

United States Patent [19]

Naab et al.

[11] Patent Number: 5,148,346

[45] Date of Patent: Sep. 15, 1992

[54] EMI PROTECTED WATER-ACTIVATED PRESSURIZED GAS RELEASE APPARATUS

[75] Inventors: Carlton W. Naab, Safety Harbor; Wayne T. Thompson, Pinellis Park, both of Fla.

[73] Assignee: Conax Florida Corporation, St. Petersburg, Fla.

[21] Appl. No.: 763,743

[22] Filed: Sep. 20, 1991

[51] Int. Cl.[5] ..... F23Q 7/02

[52] U.S. Cl. ..... 361/251; 441/96

[58] Field of Search ..... 361/251; 441/94, 96; 102/16, 28; 9/318; 137/392; 222/5

[56] References Cited

U.S. PATENT DOCUMENTS 4,024,440 5/1977 Miller ..... 441/96

4,768,128 8/1988 Jankowiak et al. ..... 361/251

4,927,057 5/1990 Janko et al. ..... 222/5

*Primary Examiner*—Donald Griffin

*Attorney, Agent, or Firm*—Hodgson, Russ, Andrews, Woods & Goodyear

[57] ABSTRACT

Water-activated pressurized gas release apparatus which has enhanced protection from the effects of EMI radiation which may inadvertently cause firing thereof. The apparatus is enclosed in a pair of electrically conductive casings to form a Faraday cage. An interface between the casings which may afford an EMI radiation pathway to the circuitry is blocked to the passage of EMI radiation by a portion of one of the casings which overlaps the interface as a skirt. An EMI filter is provided in the passage between the battery bore and a cavity containing electrical circuitry to shunt EMI radiation passing therein through a capacitor to ground.

12 Claims, 3 Drawing Sheets

EMI PROTECTED WATER-ACTIVATED PRESSURIZED GAS RELEASE APPARATUS

The present invention relates generally to water activated pressurized gas release devices such as, for example, shown in U.S. Pat. Nos. 4,024,440 and 4,768,128. Both of these patents, which are assigned to the assignee of the present invention, are incorporated herein by reference. Such devices are utilized for inflating flotation equipment automatically when dumped into the water.

Water activated pressurized gas release devices of the type shown in the aforementioned patents have been used in a very satisfactory manner by naval aviators, the purpose of the device being to inflate a pilot's life vest should he accidentally land in water after bailing out of an aircraft. Many seamen who work with the pilots are also desirous of having such devices made available to them in case they should inadvertently fall off the deck of an aircraft carrier or the like.

Water activated pressurized gas release devices have been provided wherein the sensor and electronics are enclosed in one housing assembly, the primer and pressurization mechanism are enclosed in another housing assembly, and the two housings are attached together to form the device. Such a device is shown at 10 in FIG. 1. The device 10 includes a casing 12 composed of aluminum for containing a water activated sensor plug assembly 14, a pair of batteries 16 in series, and electric circuit means 18 connected to one terminal of the batteries 16 for supplying electrical energy for passing through a bridge wire to fire a primer, as discussed in the aforesaid '128 patent. The primer and pressurization means are provided in casing 20, which is also composed of aluminum, and are similar to those as shown in the aforesaid '128 patent. Therefore, only a portion of the casing 20 is shown in FIG. 1. The casings 12 and 20 are attached together by screws 48.

The electric circuit means is grounded to the casings 12 and 20. Entrance of sea water or other fluid of sufficient conductivity between the sensor, which is connected to the other terminal of the batteries, and the casings 12 and 20 thereby closes the circuit to provide electrical energy to the bridge wire for firing of the primer.

The single piece case 12 has a bore 22 in which are inserted the batteries 16 with one of the batteries sticking out the end thereof. A sensor cap 24 containing the sensor, which is in electrical contact with the batteries 16 by means of spring 26, closes the end of the bore 22 and is threadedly secured to the housing 12 with the end thereof dead-headed against a shoulder of the housing 12. Sensor cap 24 is composed of a plastic material which, in order to provide an adequate moisture seal with the casing 12, is subject to being over-torqued so that it may tend to undesirably crack.

The electrical circuit means 18 is contained within a cavity 28 of the housing 12, there being an opening 30 thereto along the interface with the primer casing 20. Thus, circuit board 32 supports a pair of sockets 34 and 36 for a contact pin for the primer and a contact pin for ground to the body respectively. A passage 38 extends between the bore 22 and the cavity 28, and a battery contact pin 40 is disposed within the passage 38 for electrical contact with the adjacent battery 16. A hook-up lead 42 extends from the pin 40 into the cavity 28 for electrically connecting the batteries 16 to the circuit 18 therein. A bushing 44 of non-conductive material is provided between the pin 40 and the case 12 in order to insulate the pin therefrom. The circuit 18 is similar to that shown in FIG. 5 of the '440 patent except that circuit 18 also includes a thermistor in series with the resistor shown at 93 in FIG. 5 thereof.

The components for the circuit 18 and the circuit board 32 are held in position by a soft potting compound 46. However, this potting compound may undesirably allow the circuit board 32 to flex during firing of the primer.

Exposure of the circuit 18 to unwanted electromagnetic radiation, commonly known as EMI, may result in unintentional firing of the primer. Efforts have been made to reduce the possibility of such undesired firing due to EMI radiation. One way of doing this is to surround the electrical components by electrically conductive material, commonly known as providing a Faraday cage. Thus, the single piece casings 12 and 20 of electrically conductive material of the apparatus of FIG. 1 absorb EMI radiation so that it does not enter the cavity 28 to interfere with the circuit 18, thus providing a Faraday cage thereabout. As noted in the '440 patent, the capacitor, illustrated at 88 in FIG. 5 thereof, provides an additional degree of protection by shunting EMI radiation to ground.

While the Faraday cage just described reliably affords a high degree of EMI protection, there are still ways in which EMI radiation can enter. Thus, EMI radiation may enter, as illustrated at 50, into the cavity 28 by traveling between the surfaces of the casings 12 and 20, i.e., along the interface thereof. In order to absorb such EMI radiation so that it does not pass into the cavity 28 for interference with the circuit 18 and inadvertent firing of the primer, the opening 30 is stepped, and a conductive gasket 52 is provided within the stepped opening to overlap the interface between the casing surfaces. The gasket 52 is composed of a rubber based material for maintaining resilience and is impregnated with silver particles to provide good electrical conductivity.

While the assembly shown in FIG. 1 reliably affords a high degree of EMI protection, government standards have been increased in recent years to require even higher levels of protection. In order to meet the higher government standards, it is desirable to eliminate any additional avenues of possible EMI interference.

It is accordingly an object of the present invention to provide increased EMI protection for a water activated pressurized gas release device.

It is another object of the present invention to eliminate the possibility of cracking of the sensor cap during torqueing while still providing an adequate moisture seal.

It is a further object of the present invention to provide a casing for the electrical circuitry for such a device which is inexpensive, non-complex, and easy to assemble to the primer casing.

It is yet another object of the present invention to provide such a circuit casing which is constructed to receive existing primer casings.

It is yet another object of the present invention to provide such a device which affords increased protection to the electronics so that the circuit board does not flex during firing of the primer.

In order to provide increased EMI protection, in accordance with the present invention the water activated pressurized gas release device is constructed to have a portion or skirt which overlaps the interface between the circuit and primer casings, and the passage between the bore for the battery or batteries and the electronics cavity is provided with an EMI filter electrically connected between the electronics lead wire and the circuit casing with at least one capacitor to shunt EMI radiation into the circuit casing to ground. In order to reduce the torque required for maintaining a moisture seal between the sensor cap and the circuit casing, an o-ring is provided between the end portion of the cap and the casing to provide the seal. A rigid potting compound such as, for example, Hysol potting compound is provided within the cavity to provide a harder set so as to prevent the circuit board from flexing during firing of the primer.

The above and other objects, features, and advantages of the present invention will be apparent in the following description of the preferred embodiment when taken in conjunction with the accompanying drawings wherein like referenced numerals denote like or similar parts.

DETAILED DESCRIPTION OF THE PREFERRED EMBODIMENTS

Figure 2:
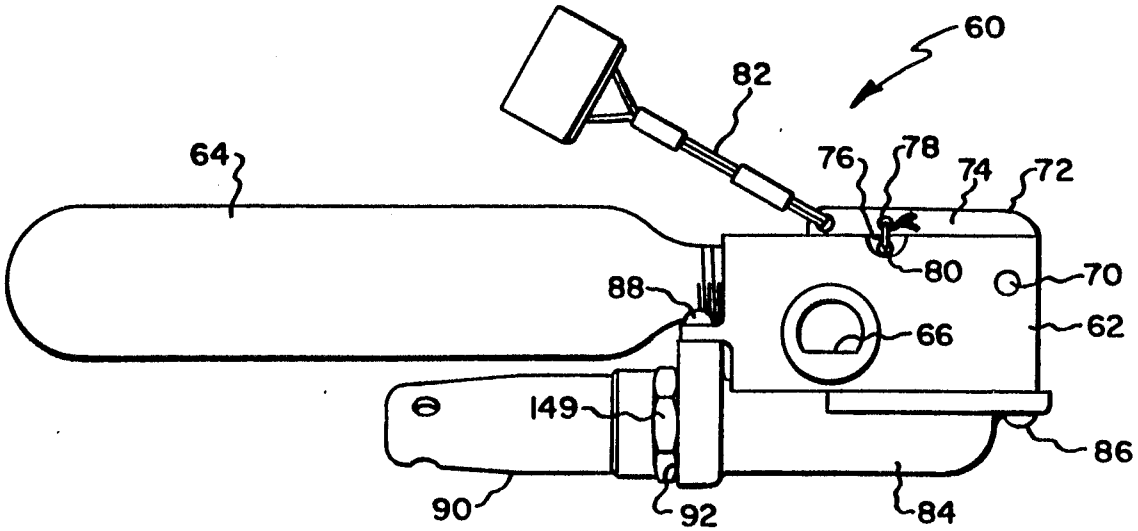
FIG. 2 is a side elevational view of a water activated pressurized gas release device in accordance with the present invention.

Referring to FIG. 2, there is shown generally at 60 a water activated pressurized gas release device which includes a housing 62 for a primer (non shown) for releasing from container 64 pressurized gas through d-shaped transfer hole 66 which extends through the wall of the housing 62 and is adapted to receive a stem (not shown) on a article to be inflated such as a life vest or life raft. The pressurized gas container 64 is replaceably mounted to the housing 62 by suitable means such as screw threads 68. Pivotly mounted on a transverse horizontal pivot pin 70 is an L-shaped cam lever 72 including a cam portion (not shown) and an elongated arm portion 74. Normally, cam lever 72 is secured in the inoperative position shown in FIG. 2 by a relatively soft safety wire loop 76 passing through transverse holes 78 and 80 provided in the cam lever 72 and housing 62 respectively. A pull 82 is shown as suitably attached to the free end of the arm portion 74 of the cam lever and is provided for manually pulling this arm portion upwardly so as to break the wire loop 76 and rotate cam lever 72 for manually effecting release of pressurized gas from container 64 as more fully described in the aforesaid '440 patent.

Primer casing 62 is attached to a sensor assembly 92, which contains a sensor and electrical circuitry for firing the primer. The sensor assembly 92 includes a single piece casing 84 housing the various circuit components described hereinafter and a sensor cap 90 housing the sensor device therefor. Casing 62 is attached to casing 84 by means of screws 86 and 88 or by other suitable means. Both housings 62 and 84 are composed of aluminum or other suitable conductive material so as to form a Faraday cage about the electrical circuitry, illustrated generally at 102, for preventing EMI induced unintentional firing of the primer, as hereinafter discussed. The sensor cap 90 is threadedly attached to the sensor housing 84 and is composed of a suitable material such as plastic, as hereinafter described.

Figure 3:
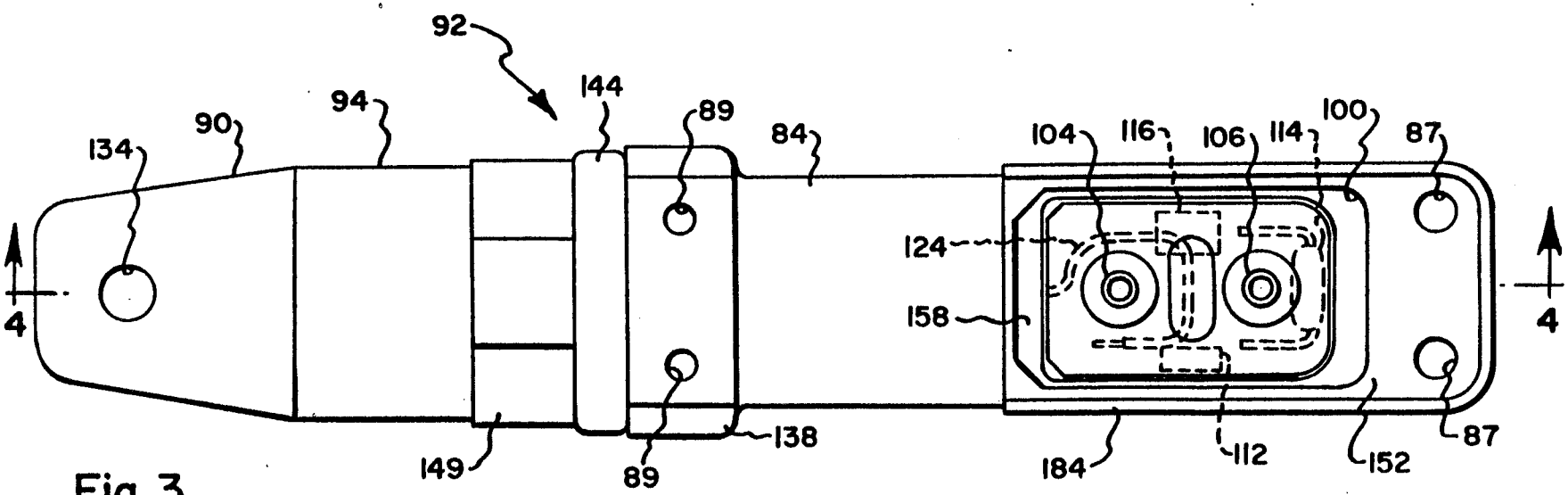
FIG. 3 is a plan view of the sensor assembly for the device of FIG. 2.
Figure 4:
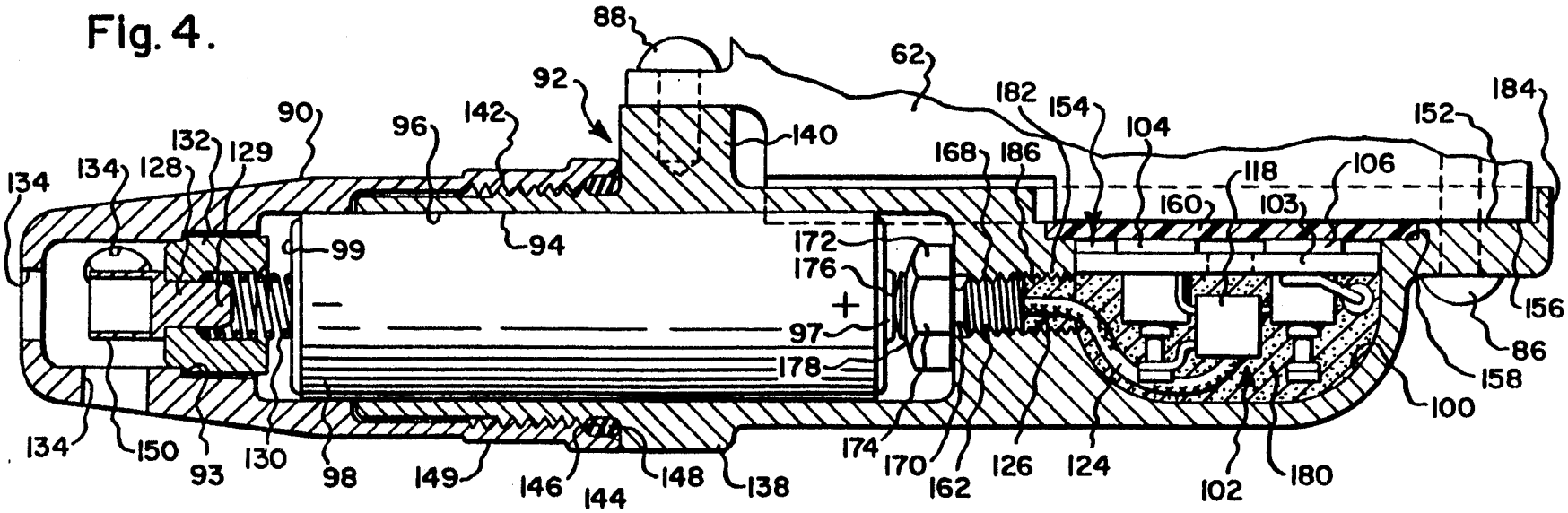
FIG. 4 is a sectional view of the sensor assembly of FIG. 3 taken along lines 4—4 thereof.
Figure 5:
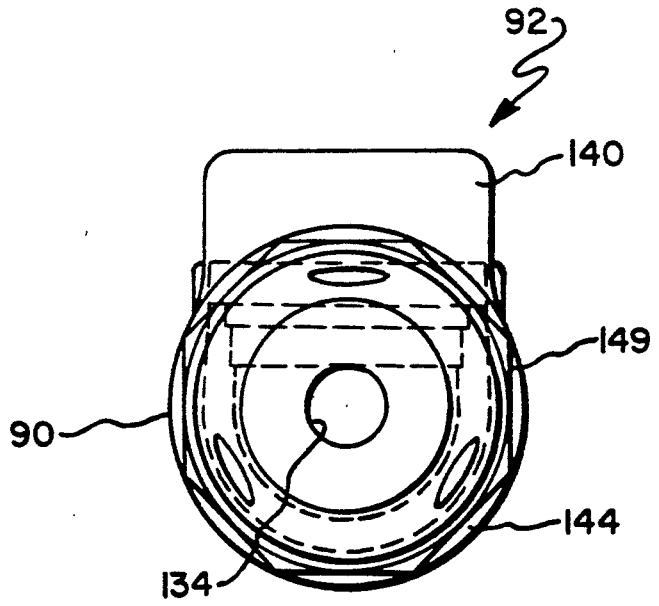
FIG. 5 is an end view of the sensor assembly of FIG. 3 as viewed toward the sensor cap end thereof.

Referring to FIGS. 3, 4 and 5, there is shown the sensor assembly 92 in greater detail. The circuit housing 84 is of a single piece cast aluminum construction which contains a generally cylindrical portion 94 in which is provided a bore 96 in which is received a battery 98 the end of which is sticking out the end of the bore 96. Battery 98 has a positive terminal 97 at one end and a negative terminal 99 at the other end. It should be understood that the bore 96 may contain more than one battery in series with the positive and negative terminals at opposite ends of the series of batteries. A cavity 100 is also provided in the casing 84 for containing the various elements of the electric circuit means 102 for supplying electric energy to a bridge wire, illustrated at 120 in FIG. 6, for igniting an explosive material in the primer (not shown). At 103 is shown a circuit board to which are attached plugs 104 and 106 for the bridge wire 120 and for connection to the housing 62 to ground respectively. Primer socket 104 receives the primer contact pin (not shown), and the socket 106 receives the body ground contact pin (not shown). The circuit board 103 is composed of electrically non-conductive material and has separate positive and negative electrically conductive plates, illustrated at 108 and 110 respectively in FIG. 6, suitably secured to the lower side thereof. Socket 106 is electrically connected to the negative plate 110. A capacitor 112 has one lead soldered to the positive plate 108 and the other lead soldered to the negative plate 110. A thermistor 114 has one lead soldered to the positive plate 108 and the other lead soldered to a lead of a resistor 116 the other lead of which is soldered to the negative plate 110 so that the thermistor 114 and resistor 116 are connected in series.

Figure 6:
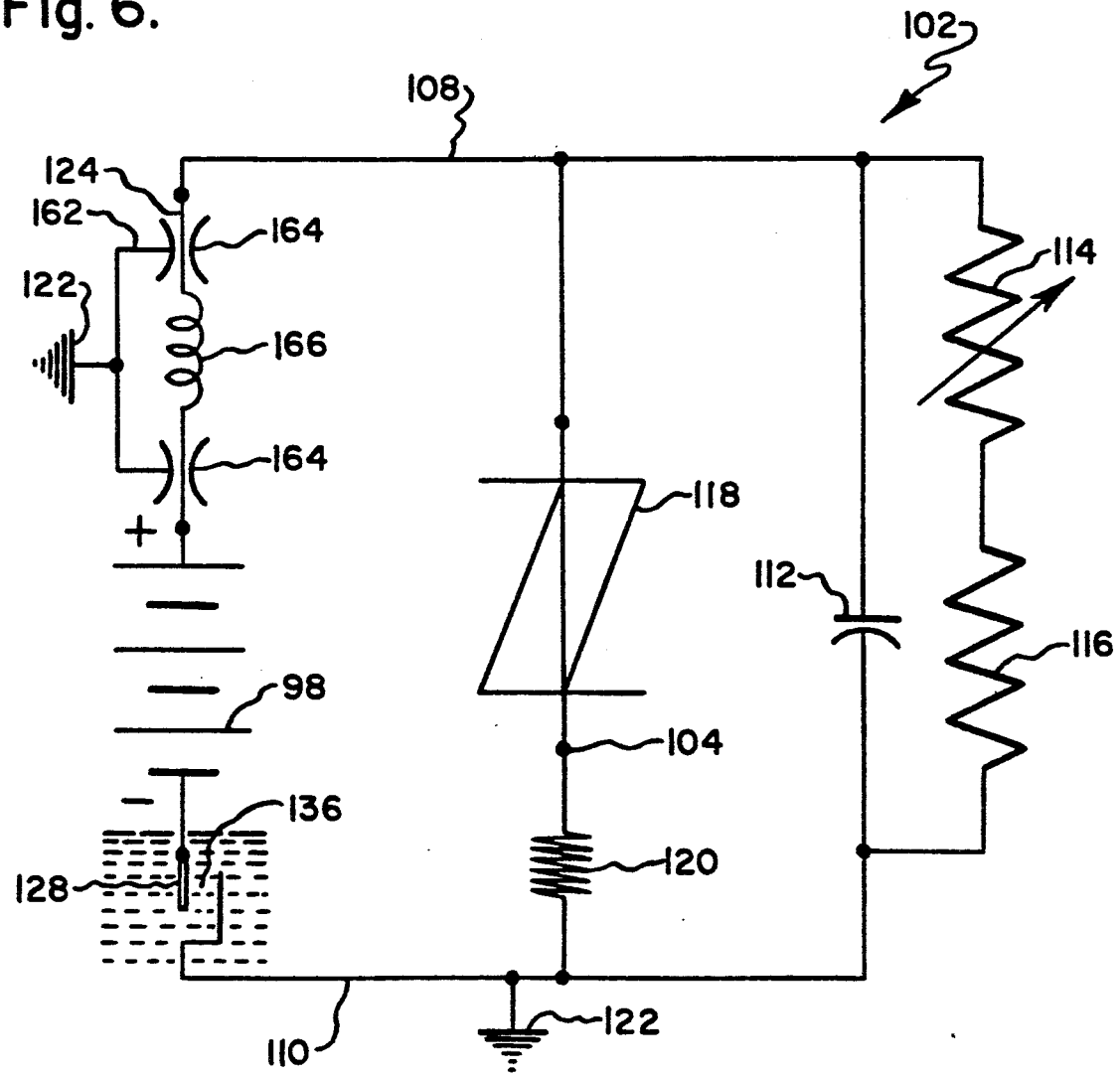
FIG. 6 is a schematic view of the electrical circuit for the device of FIG. 2.

A breakdown diode or bi-directional switch 118 has one terminal connected to the positive plate 108 and a second terminal connected to primer socket 104 which, as shown in FIG. 6, is electrically connected to bridge wire 120 for the primer (not shown). As also shown in FIG. 6, the bridge wire 120 and negative plate 110 are connected to ground, illustrated at 122. The breakdown diode 118 may be selected to conduct at a voltage of perhaps between about 7 and 9 volts to provide suitable power for the bridge wire 120, which may have a resistance of perhaps 2 to 5 ohms. If desired, a third terminal of the breakdown diode may be provided to be electrically connected, in accordance with principles commonly known to those of ordinary skill in the art to which this invention pertains, to conduct at a different voltage. A lead wire 124 is connected to the positive plate 108 and extends into a cylindrical passage 126 which runs between the cavity 100 and bore 96 for electrical connection to the positive terminal 97 of the battery 98, as hereinafter discussed.

The negative terminal 99 of the battery 98 is electrically connected to sensor pin 128, composed of electrically conductive material, via spring 130. The sensor cap 90, which contains sensor pin 128, is composed of non-conductive material such as a plastic so as to prevent water from inadvertently electrically connecting the pin 128 to cap 90 to close the circuit. The sensor pin 128 has a shank 129 which is received by and friction welded to ferrule 132 which is in turn friction welded to the sensor cap 90 to thereby provide an environmental seal between battery 98 and sensor pin portion 131 which protrudes from the ferrule opening for contact by water. The inside surface of the cap 90 is stepped to provide a shoulder 93 for checking movement of the ferrule 132 away from battery 98.

If the device 60 is immersed in sea water or other electrically conductive fluid, the fluid would flow through the holes 134 into the interior of the sensor cap 90 filling the space around and contacting the sensor pin portion 131. Since this water, illustrated at 136 in FIG. 6, is also in contact with the conductive housings 62 and 84 when the device 60 is immersed therein, the circuit 102 will be closed resulting in a flow of electrical energy through bridge wire 120 to fire the primer (not shown). For the purposes of this application, the term "water" is meant to include any electrically conductive fluid, i.e., a fluid having a conductance equal to or greater than about 90 micromhos per centimeter.

The housing 84 is shaped to provide a radially outwardly extending ring 138 which acts as a shoulder against which the end of the plastic sensor cap 90 is dead-headed to prevent cracking when tightened onto the housing 84. This ring 138 has a radially outwardly enlarged portion 140 providing a mounting portion for the primer housing 62 which is attached thereto by means of screw 88. The sensor cap 90 is attached to the housing 84 by means of mating threads illustrated at 142 on the inner surface of the cap and on the outer cylindrical surface of the housing 84. The sensor cap 90 has an end portion 144 adjacent the threads 142 and which abuts the shoulder of ring 138 when the cap 90 is tightened onto the housing 84. The end portion 144 has an inner surface 146 which is radially outwardly of the inner surface of the remainder of the cap 90 so that the end portion 144 is radially spaced from the outer surface of the cylindrical portion 94 of housing 84 so as to capture a suitable o-ring 148 therebetween to thereby provide a moisture seal with reduced torque whereby the possibility of cracking the plastic sensor cap 90 may be reduced. The sensor cap 90 is provided with standard size wrench flats 149 thereabout such as, for example, standard ¾ inch wrench flats, so that the cap 90 may be tightened onto housing 84 with a standard wrench rather than the requirement of a special wrench therefore.

If the sensor pin portion 131 were solid it may tend to ice up quickly when immersed in water close to the freezing point. However, ice is not conductive. The sensor pin portion 131 therefore has a hollow wall, as known in the art, which does not ice up as quickly so as to provide increased assurance of closing the circuit when the device 60 is exposed to freezing temperatures.

Figure 1:
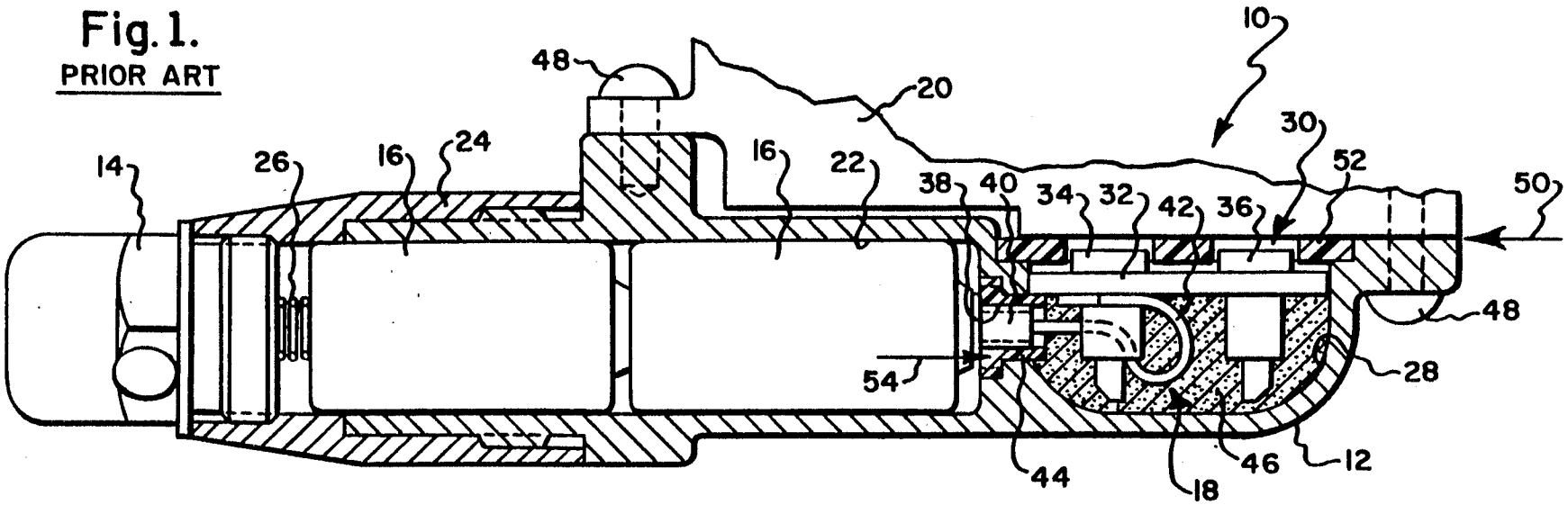
Fig. 1. PRIOR ART
FIG. 1 is a longitudinal sectional view of a sensor assembly illustrating its attachment to a primer casing for a water activated pressurized gas release device of the prior art.

The circuit housing 84 has a surface 152 in which an opening 154 is provided to the cavity 100 and which interfaces with a surface 156 of the primer housing 62 for attachment of the housings. The opening 154 is stepped to provide a surface 158 on which is disposed a silver gasket 160, which is similar to silver gasket 52 in FIG. 1, the silver gasket 160 being disposed to lie between surfaces 158 and 156 when the primer and circuit housings are attached to absorb any EMI radiation which may pass along the interface between surfaces 152 and 156. The surfaces thereof may not be lapped together adequately with the result that sufficiently perfect contact is not maintained. Over time the silver gasket 160 may also deteriorate or take a set and become less flexible. Such deterioration may be to such an extent that EMI radiation passing along the interface may not be stopped by the silver gasket 160 so that the possibility of its passing into contact with the electric circuit 102 to inadvertently effect firing of the primer is increased. Since electromagnetic waves flow in straight lines, in accordance with the present invention the housing 84 is provided with a portion or skirt 184 which extends normal to surface 152 to block or overlap the interface between surfaces 152 and 156 and thereby reduce the possibility of EMI radiation passing into the interface to travel along the interface and penetrate to the electric circuitry 102.

Although EMI radiation only travels in a straight line, it can bounce off of surfaces. Thus, EMI radiation may pass through the plastic material of the sensor cap 24 and along the bore 96 between the bore wall and the battery 98 until it hits the end of the wall of the bore. The EMI radiation may then bounce back and forth between the end wall and the battery with the result that some of the radiation may pass into the passage 126 for interference with the electrical circuit 102 and inadvertent firing of the primer, if the passage 126 is not otherwise protected. Such a flow of EMI radiation into an unprotected passage is illustrated at 54 in FIG. 1. In order to prevent such EMI radiation from entering the cavity 100, in accordance with the present invention a filter 162 is provided in the passage 126 for shunting such EMI radiation through a pair of capacitors, illustrated at 164 in FIG. 6, to ground 122, i.e., the electrically conductive wall of the passage 126. The filter 162 is shown to be a pi filter which includes two such capacitors 164 along with a ferrite inductor 166. However, other suitable filters may be employed such as, for example, one having a single capacitor, one known as an L-thread filter having a capacitor in series with an inductor, or one known as a multi-section having three or more capacitors in series alternately with two or more inductors. Such other filters are meant to come within the scope of the present invention.

EMI filter 162 suitably has a stainless steel housing and has a minimum capacitance of about 1,650 picofarads, insulation resistance of at least about 10,000 megohms at 200 volts DC, a current rating of perhaps perhaps 500 milliamps, and an axial load on the battery contact of a maximum of 5.0 pounds between −20 and +160 degrees Fahrenheit. Such a pi filter may suitably be of a type as provided by Spectrum Control, Inc. of Erie, Pa. or Murata Erie of Trenton, Ontario. The body of filter 162 has screw threads 168 which threadedly engage mating screw threads 186 on the wall of the passage 126 for threadedly securing the filter 162 in the passage and in electrically conductive contact with the sensor housing 84 for shunting of EMI radiation through the capacitors 164 to ground.

The filter 162 has a neck portion 170 and a head portion 172, the neck portion 170 being between the head portion 172 and the body of the filter. The head portion 172 is provided with flats 174 for a standard size socket wrench so that the filter 162 may be threadedly secured in the passage 126 by means of a suitable socket wrench with the head portion 172, which overlaps the passage 126, remaining within the bore 96. The head portion 172 is provided with a battery contact 176 which is nickel or tin plated or otherwise suitably plated and is insulated from the conductive head 172 by a hard epoxy 178. The lead wire 124 is suitably electrically connected to the battery contact 176 in accordance with principles commonly known to those of ordinary skill in the art to which this invention pertains.

In order to prevent flexing of the circuit board 103 during firing, a potting material, illustrated at 180, is provided within the cavity 100 about the circuit board 103 as well as the other electrical components so as to secure their positions. The potting material 180 is selected to set up sufficiently hard that it is rigid sufficiently to prevent such flexing of the circuit board. An example of such a hard-setting potting material is Hysol potting material.

The aluminum housing 84 is anodized except for the portion 182 which contains the threads 186 which receive the EMI filter 162. During the anodizing process this threaded area 186 is plugged and is subsequently coated to improve the electrical conductivity thereof.

It should be understood that while the invention has been described in detail herein, the invention can be embodied otherwise without departing from the principles thereof, and such other embodiments are meant to come within the scope of the present invention as defined by the appended claims.

What is claimed is:

1. Apparatus for supplying electrical energy for firing a primer when water is detected comprising a single piece casing of electrically conductive material including bore means for receiving a battery means and further including cavity means, electric circuit means disposed at least partially in said cavity means, means defining an opening in said casing to said cavity means, said opening means including a surface peripheral of the opening for engaging a complementary surface of a housing of electrically conductive material for the primer and thereby providing an interface for attachment of the primer housing to said electric circuit casing, said electric circuit casing including a portion which extends from said opening means surface along and external of the periphery of the interface to overlap the interface and said primer housing to prevent the entrance of electromagnetic radiation between said electric circuit casing and the primer housing at the interface, passage means interconnecting said bore means and said cavity means, said electric circuit means including an electrically conductive means extending into said passage means for electrically connecting to one terminal of the battery means, sensor means for electrically connecting the other terminal of the battery means to ground upon immersion of the apparatus in water to thereby complete a circuit for firing of the primer, and electromagnetic interference filter means having at least one capacitor in said passage means and electrically connected to said conductive means for conducting electromagnetic interference radiation through said at least one capacitor to ground.

2. Apparatus according to claim 1 wherein said filter means comprises a first portion which includes said at least one capacitor and which further includes threads for threadedly engaging said passage means and a second portion defining a head of electrically conductive material disposed in said bore means to overlap said passage means.

3. Apparatus according to claim 1 wherein said bore means has a cylindrical outer surface which contains threads and has means defining a shoulder, the apparatus further comprising an end cap containing said sensor means, said end cap having threads disposed thereon for threadedly engaging said bore means threads, said end cap having a cylindrical end portion axially outwardly of said end cap threads, said bore means having means defining a shoulder for abutting engagement by said end portion when said end cap is threadedly connected to said bore means, and o-ring means, said end portion and said cylindrical outer surface radially spaced to capture said o-ring means therebetween to seal the connection of said end cap to said electric circuit casing.

4. Apparatus according to claim 1 further comprising standard size hex wrench flats on said end cap for threading thereof onto said electric circuit casing.

5. Apparatus according to claim 1 wherein said electric circuit means includes a circuit board, the apparatus further comprising potting material means within said cavity means for providing rigidity for preventing flexing of said circuit board during firing of said primer.

6. Apparatus according to claim 1 wherein said passage means includes threads for threadedly receiving said filter means.

7. Apparatus according to claim 6 wherein a portion of said passage means containing said passage means threads is unanodized, the remainder of said electric circuit casing being anodized.

8. Apparatus according to claim 7 wherein said filter includes threads for engaging said passage means threads, the apparatus further comprising a coating on said filter threads for enhancing electrical contact between said filter threads and said electric circuit casing threads.

9. Apparatus according to claim 6 wherein said filter includes threads for engaging said passage means threads, the apparatus further comprising a coating on said filter threads for enhancing electrical contact between said filter threads and said electric circuit casing threads.

10. Apparatus according to claim 1 further comprising an end cap composed of electrically non-conductive material for closing said bore means, said end cap containing said sensor means.

11. A water-activated pressurized gas release device comprising a first casing of electrically conductive material, a source of pressurized gas connected to said first casing, means for releasing the gas, a single piece second casing of electrically conductive material including bore means for receiving a battery means and further including cavity means, electric circuit means disposed at least partially in said cavity means and connected to said gas release means then to ground, means defining an opening in said second casing to said cavity means providing communication between said first and second casings for connection of said electric circuit means to said gas release means, said first and second casings connected along an interface about the periphery of said opening, one of said casings including a portion which extends along and external of the periphery of the interface and which overlaps the interface and the other of said casings to prevent the entrance of electromagnetic interference radiation between said casings at the interface, passage means interconnecting said bore means and said cavity means, said electric circuit means including an electrically conductive means which extends into said passage means for electrically connecting to one terminal of the battery means, an end cap connectable to said second casing and including means for electrically connecting the other terminal of the battery means to ground upon immersion of the device in water to thereby complete a circuit for supplying electrical energy to said gas release means, and electromagnetic interference filter means having at least one capacitor in said passage means and electrically connected to said conductive means for conducting electromagnetic interference radiation through said at least one capacitor to ground.

12. Apparatus for supplying electrical energy for firing a primer for release of a pressurized gas when water is detected comprising an electrically conductive casing including a bore means for receiving a battery means, an electric circuit means electrically connectable to one terminal of the battery means and electrically connectable to the primer then to ground, said bore means including a cylindrical outer surface having threads thereon, an end cap of plastic material having threads engageable with said bore means threads for threadedly connecting said end cap to said casing for closing said bore means, an electrically conductive sensor member within said end cap, means for electrically connecting said sensor member to the other terminal of the battery means, passage means in said end cap for flow of water therein to contact said sensor means to thereby complete a circuit upon immersion of the apparatus in water for firing of the primer, said end cap having a cylindrical end portion axially outwardly of said end cap threads, said casing having means defining a shoulder for abutting engagement by said end portion when said end cap is threadedly connected to said casing, an o-ring means, and said end portion and said cylindrical outer surface radially spaced to capture said o-ring means therebetween to seal the connection of said end cap to said casing whereby to reduce the torque required for such sealing.

* * * * *